US005078419A

United States Patent [19]

Wittmann et al.

[11] Patent Number: 5,078,419

[45] Date of Patent: Jan. 7, 1992

[54] SOLE-SUPPORT DEVICE

[75] Inventors: Heinz Wittmann; Henry Freisinger; Egon Brunnhuber; Tibor Szasz, all of Vienna; Hubert Würthner, Hainburg/Donau; Karl Stritzl, Vienna; Alois Himmetsberger, Vienna; Klaus Hölzl, Vienna; Helmut Wladar, Vienna; Robert Stanzl, Enzersdorf/Fischa; Andreas Janisch, Tribuswinkel, all of Austria

[73] Assignee: TMC Corporation, Baar, Switzerland

[21] Appl. No.: 457,810

[22] PCT Filed: Apr. 29, 1989

[86] PCT No.: PCT/EP89/00479

§ 371 Date: Jan. 8, 1990

§ 102(e) Date: Jan. 8, 1990

[87] PCT Pub. No.: WO89/10777

PCT Pub. Date: Nov. 16, 1989

[30] Foreign Application Priority Data

May 6, 1988 [AT] Austria ..... 1197/88
Jul. 15, 1988 [AT] Austria ..... 1824/88

[51] Int. Cl.[5] ..... A63C 9/08
[52] U.S. Cl. ..... 280/636
[58] Field of Search ..... 280/636, 627, 617, 618, 280/607, 5.22, 844; 198/690.2

[56] References Cited

U.S. PATENT DOCUMENTS

| | | | |
|---|---|---|---|
| 336,126 | 2/1886 | Ludlum | 198/690.2 |
| 3,079,165 | 2/1963 | Von Bosio | 280/636 |
| 3,448,990 | 6/1969 | Cubberley et al. | 280/636 |
| 3,743,310 | 7/1973 | Smolka | 280/636 |
| 3,845,965 | 11/1974 | Lipe | 280/636 |
| 4,004,824 | 1/1977 | Svoboda | 280/636 |
| 4,226,439 | 10/1980 | Kirsch | 280/628 |
| 4,268,062 | 5/1981 | Wittmann | 280/611 |
| 4,688,813 | 8/1987 | Misawa et al. | 280/5.22 |

FOREIGN PATENT DOCUMENTS

| | | |
|---|---|---|
| 292528 | 8/1971 | Austria . |
| 302129 | 1/1972 | Austria . |
| 311231 | 2/1973 | Austria . |

*Primary Examiner*—David M. Mitchell
*Attorney, Agent, or Firm*—Flynn, Thiel, Boutell & Tanis

[57] ABSTRACT

A sole support device having a support member and an endless band movably supported and guided on the support member between two edge structures extending transversely with respect to the longitudinal direction of the ski and projecting upwardly adjacent the side edges of the band. In order to avoid in such a device any damage to the band while stepping into a ski binding with a ski boot, the band consists of an endless support section and plural spaced elevations on the support section, which elevations project beyond or above the edge structures.

31 Claims, 8 Drawing Sheets

SOLE-SUPPORT DEVICE

FIELD OF THE INVENTION

The invention relates to a sole-support device.

BACKGROUND OF THE INVENTION

Such a device is already described in with reference to FIG. 5 of Austrian Patent No. 302 129. This device has the disadvantage that the band in which bearing axes are supported, which band is thicker than the height of the two moldings, is pressed forwardly beyond the edge by the ski boot when the skier steps with the ski boot into the binding and thus is easily damaged.

A similar disadvantage exists in the design according to U.S. Pat. No. 3,845,965, in which the band is only guided in lateral grooves in a plate-shaped support member. Thus, lateral moldings are missing in this design (see FIGS. 2 to 5).

This is also true for the device according to Austrian Patent No. 311 231, in which the position of the band in longitudinal direction of the ski is only defined by the bend in the support member.

Finally U.S. Pat. No. 3,488,990 shows a closed flat cushion in FIG. 5, which cushion houses a lubricant and is fastened on the upper side of the ski by means of an adhesive. The cushion is in the ball area of the ski boot. This cushion is supposed to make the release of the ski boot easier during a twisting fall of the skier.

SUMMARY OF THE INVENTION

The invention has the purpose of overcoming the disadvantages of the known designs and to provide a sole-support device which reliably avoids damage to the endless band when the skier steps with the ski boot into the binding.

This purpose is attained according to the invention by making the support section of the band thinner than the height of the two moldings, so that a reliable guiding of the band relative to the support member is assured, even when elastic bands are used. In addition, a reliable contact of the ski boot with the band is created by arranging elevations on the band.

Various solutions are offered for the design of the elevations. Raised ribs, which extend transversely to the length of the band, has proven to be particularly advantageous, since this measure prevents an unintended placement of the ski boot on the lateral moldings, even when the skier is a heavy person.

A breaking of the support member into multiple components eases the installation of the band through the provision of an adjusting mechanism for the support section of the support member.

The adjusting mechanism can be a key or a cam-shaped or eccenter-shaped rotatable insert insertable between the multiple components.

The support section of the support member, which support section is used to support the band, is formed by two tensioning parts which are supported in transversely extending guideways on the support member and are pressed outwardly by at least one spring. This assures an even tensioning of the band.

The spring or springs can thereby be formed by two bars resting against one another and being die-cast of plastic together with the two tensioning parts.

The installation of the band becomes particularly easy by breaking the support member into two parts.

The provision of a cover plate substantially protects the inside of the device against the influences of the environment. A low friction course is guaranteed for the band by the surface design of the cover plate. The position of the cover plate in the device is thereby reliably and favorably assured by the measures of a cover plate locking structure.

An easy installation or mounting of the two tensioning parts together with the band in the support member of the device can be accomplished by providing a groove into which is received the band.

One can prevent an unintended lifting of the band off from the support member by providing an edge structure on the band which operatively grips structure associated with the support member.

Further structure can be provided on the support member for guaranteeing a reliable connection of the two parts of the support member and yet have the additional advantage that the support member, during assembly, can easily be adjusted to the width of the band being used. The band can therefore differ in its width to a certain degree from a desired value and still experience a good guiding.

If the band, however, also differs in its length from the pregiven desired value, then this difference can be balanced or compensated for by appropriate engaging surfaces on the support member. If desired, the two support members can be connected through friction contact structure.

The support section can, due to its one-piece design, be exposed, in the embodiment according to claim 18, to greater loads or stresses than in the preceding exemplary embodiment. Moreover, the manufacture of the support member is easier.

BRIEF DESCRIPTION OF THE DRAWINGS

Other objects and purposes of the invention will become apparent to those of ordinary skill in the art following a reading of this text with reference to the accompanying drawings, in which:

FIG. 7 illustrates two tensioning parts being uniformly loaded by springs;

FIG. 8 is a diagram of a detail of a modified embodiment of FIG. 7;

FIG. 9, which is a cross-sectional view, illustrates the springs being constructed in one piece with the tensioning parts manufactured of plastic;

DETAILED DESCRIPTION

Figure 1:
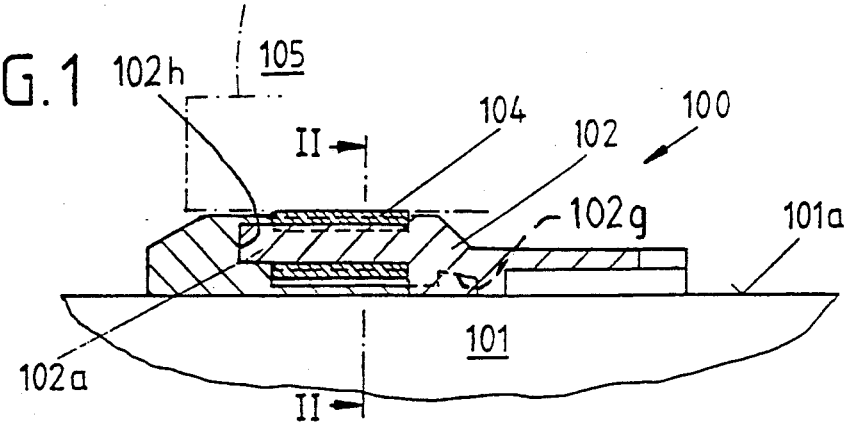
FIG. 1 is a cross-sectional view of a first embodiment taken along the line I—I of FIG. 2.
Figure 1A:
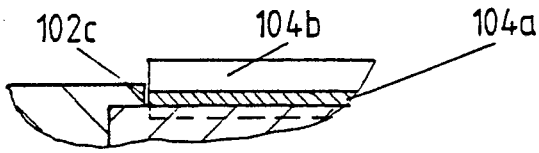
FIG. 1*a* illustrates a detail in an enlarged scale.
Figure 2:
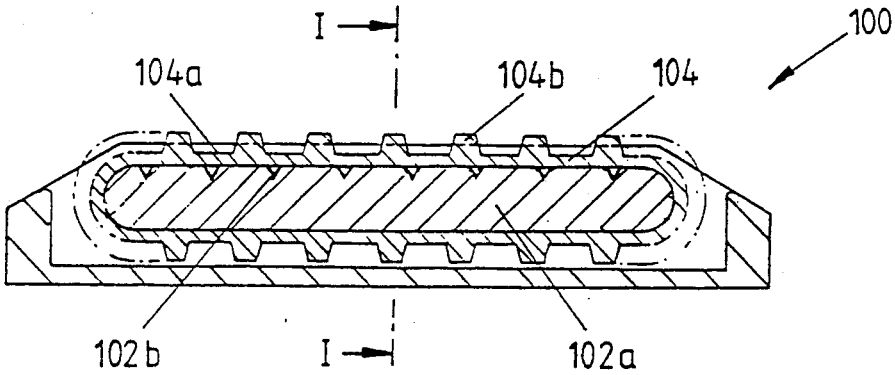
FIG. 2 is a cross-sectional view taken along the line II—II of FIG. 1.
Figure 3:
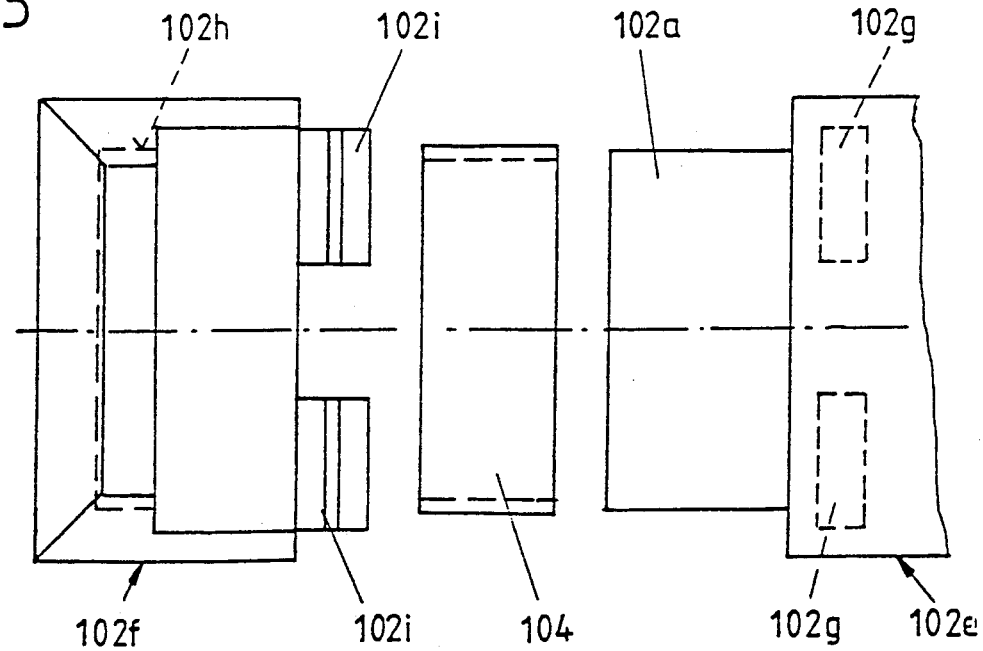
FIG. 3 is a top view, with the individual parts being illustrated in a pulled-apart position.

Referring to FIGS. 1 to 3, the sole support device illustrated in FIGS. 1 to 3 is identified in its entirety by the reference numeral 100. The sole support device has a support member 102 fastenable to an upper side 101*a* of a ski. A continuous band 104 is movably supported on a central support section 102*a*, hereinafter also identified as a section, of the support member 102. The upper side of the section 102*a* has recesses 102*b* adapted to receive a lubricant therein. Edge moldings 102*c* (FIG. 1*a*) exist on both sides of the band 104, which moldings prevent the band 104 from moving in a longitudinal direction of the ski.

The band 104 in the illustrated exemplary embodiment is designed as an elastic toothed belt-like band of plastic or rubber, with a support section 104*a* thereof being thinner than the height of the two edge moldings 102*c*. Ribs 104*b* extending in a transverse direction of the length of the band 104 are provided on the support section 104*a*, which ribs project beyond or above the horizontal plane of the edge moldings 102*c* and serve to support a ski boot 105, for example in its ball area.

In place of an elastic band, it is also possible to use a jointed plastic or metal band with ribs of plastic or rubber attached to its outer side. Since, however, such a band cannot be expanded manually, the support member 102 must in this case be designed as a slotted member or divided into multiple components to enable a mounting of the band 104 on the section 102*a*.

Since a one-piece design of the support member 102 is known to the average man skilled in the art, same will not be discussed. A divided embodiment will now be discussed in greater detail in with reference to FIG. 3.

As one can recognize better in FIG. 3, the support member 102 of the device 100 consists of two parts 102*e*, 102*f*, the separating line of which extends transversely with respect to the longitudinal direction of the ski. The part 102*e* has thereby a support section 102*a* and in its underside pocket-like recesses 102*g*. The other part 102*f* of the support member has a guideway 102*h* for receiving at least a portion of the support section 102*a* therein. Furthermore, tongues 102*i* are provided on the part 102*f*, which tongues, in an assembled state of the device 100, extend or snap into the pocketlike recesses 102*g* (compare FIG. 1). Edge moldings 102*c* for guiding the band 104 are provided on the upper side of the two parts 102*e*, 102*f*.

Since, as a rule, both parts 102*e*, 102*f* are die-cast of plastic, their manufacture is simple.

When the skier inserts his boot 105 into the binding (not illustrated), the ski boot 105 slides along the ribs 104*b* slightly compressing the band 104. However, the degree of this deformation is not sufficient to cause the ski boot 105 to rest on the support member 102.

If the skier experiences a twisting fall during skiing, then the ski boot 105 slides over the support member 102 in a sidewardly transverse direction. The band 104 is thereby moved and carried along by the ski boot 105 due to friction therebetween. The friction between the band 104 and the support member 102 is reduced by the lubricant existing in the grooves 102*b*. However, there exists also the possibility of manufacturing the support member of a low friction plastic and to possibly do without a lubricant, which must periodically be replenished.

It is also possible to provide a webbing of a low friction plastic on the inner side of the band 104.

Referring to FIGS. 4 to 6*b*, the sole support device is referenced by the numeral 200.

Figure 5:
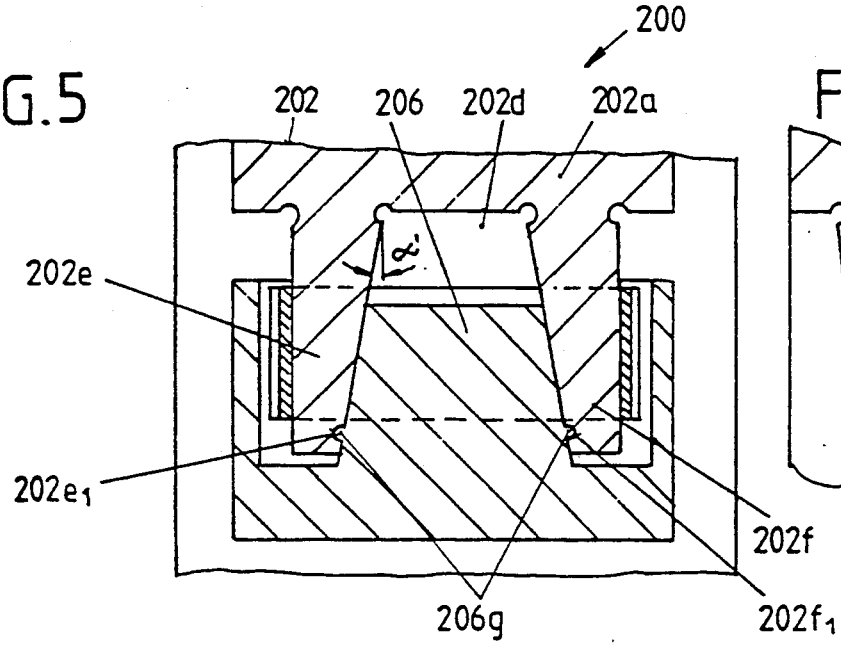

The support member 202 is manufactured of plastic in the device 200 and is provided with a recess 202*d* which opens in a longitudinal direction of the ski. The recess 202*d* divides the support section 202*a* into two prongs 202*e*, 202*f* which extend generally parallel to the longitudinal axis of the ski. A spreader for the prongs 202*e*, 202*f* is received in the recess 202*d*, and between the prongs 202*e*, 202*f*, which spreader is according to FIG. 5 a key 206. The inner facing or opposing sides of the two prongs 202*e*, 202*f* extend in FIG. 5*a* —when the key 206 is not inserted—each at an acute angle $\alpha$ with respect to the longitudinal axis of the ski. However, when the key 206 is inserted, as shown in FIG. 5, then the two prongs 202*e*, 202*f* are pressed outwardly by the key 206 so that the inner facing sides of said prongs now define an enlarged acute angle $\alpha'$ with respect to the longitudinal axis of the ski. Locking recesses $202e_1$, $202f_1$ exist on the inner facing sides of the prongs 202*e*, 202*f*, into which recesses locking projections 206*a* on the key 206 can be received. In order to reduce the occurrence of nonpermissibly large stresses on the material during operation, all edges of the support member 202 are rounded in a conventional manner.

The band 204, which is here designed, for example, as a jointed band, is in the initial position of the device 200, thus when the recess 202*d* in the support member 202 is not yet widened due to an insertion of the key 206, moved onto the two prongs 202*e*, 202*f* in an encircled relation thereto. The key 206 is thereafter moved into the recess 202*d* and locked therein widening the recess 202*d* so much so that an orderly guiding of the band 204 is assured.

Figure 4:
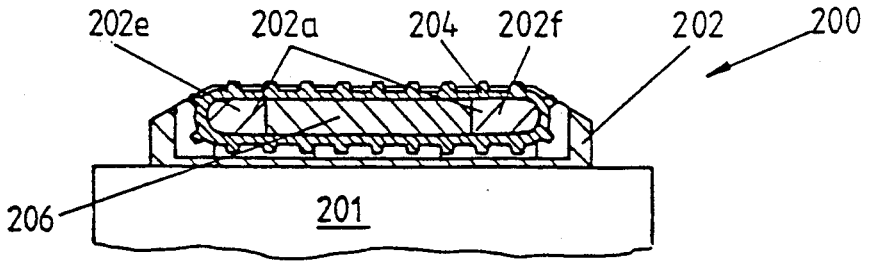
FIGS. 4 and 5 are cross-sectional views of one exemplary embodiment, in which a jointed band after being mounted is subjected to tension.
Figure 5A:
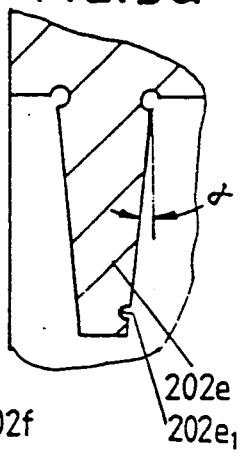
FIGS. 5*a*, 6*a* and 6*b* illustrate further details in an enlarged scale.
Figure 6:
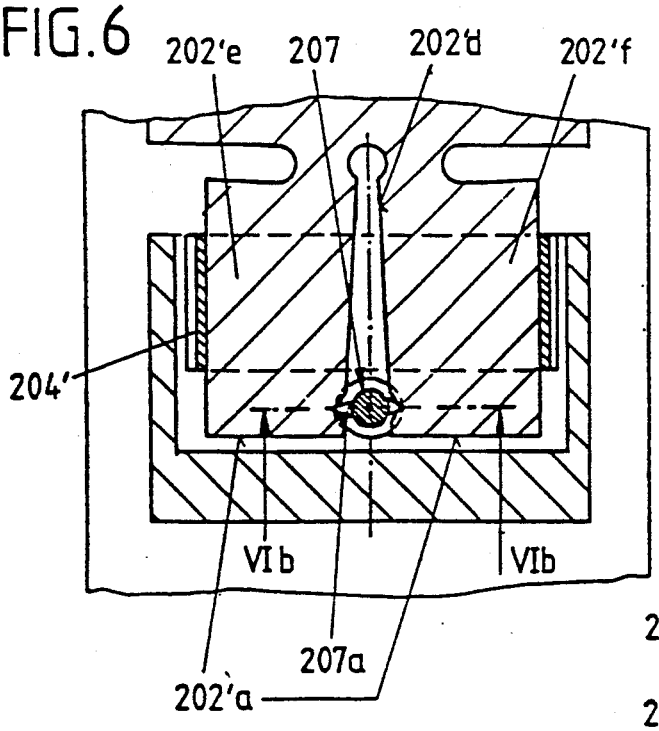
FIGS. 6 to 9 illustrate modifications of FIG. 4.
Figure 6A:
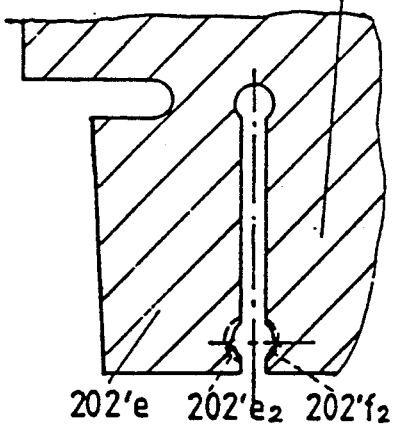
Figure 6B:
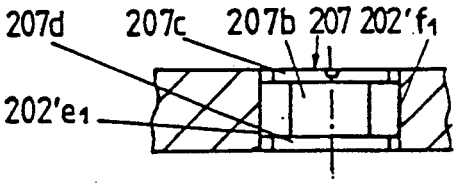

The embodiment according to FIGS. 6, 6*a* and 6*b* differs from the one according to FIGS. 4, 5 and 5*a* due to the provision of a cam-shaped or eccentric rotatable insert member 207 in the place of a key, which insert member 207, when rotated, presses or spreads the two prongs 202'*e*, 202'*f* apart, thus causing a tensioning of the band 204'. The insert member 207 is provided with two projections 207*a* arranged symmetrically to one another, which projections are initially oriented to extend in a plane generally parallel to the longitudinal direction of the recess 202'*d* at the time that the insert member 207 is movably guided into the recess 202'*d*. To support the insert member 207 in the support section 202'*a*, a pair of opposing receiving pockets $202'e_2$, 202'$f_2$ are provided between the two prongs 202'*e*, 202'*f*. A shaft segment 207*b* on the insert member 207 is supported between the opposing receiving pockets, which shaft segment 207*b* extends perpendicularly with respect to the upper side of the ski. To lock the insert member 207 in its axial position, relative to the prongs, both ends of the shaft segment 207*b* are provided with radially outwardly extending flanges 207*c*, 207*d* which are adapted to be received in recesses adjacent opposite ends of the opposing receiving pockets 202'$e_2$, 202'$f_g$ in the two prongs 202'*e*, 202'*f*. An upper one of the flanges 207*c* has a slot adapted to receive therein the blade of a screwdriver. The two projections 207*a* move into the receiving pockets 202'$e_2$. 202'$f_2$ of the two prongs 202'*e*, 202'*f* when the position of the insert member 207 is pivoted or rotated through 90°.

Figure 7:
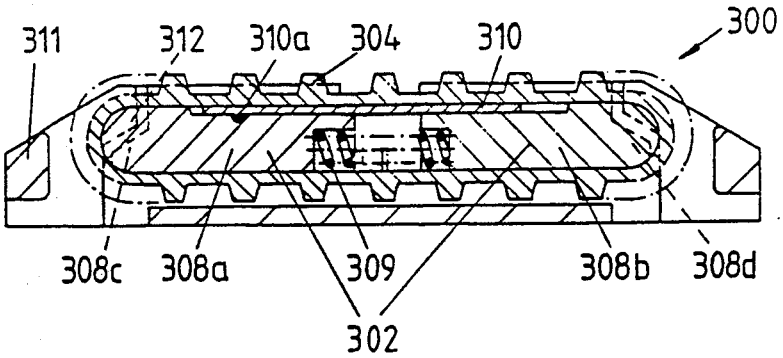

The sole support device 300 according to FIG. 7 is distinguished by the support section of the support member 302, which support section is provided for supporting the band 304, being formed by two band tensioning parts 308*a*, 308*b*, which with their two longitudinal sides are guided in guideways in the support member 302. Both band tensioning parts 308*a*, 308*b* are loaded or biased by at least one compression spring 309 to urge the tensioning parts away from one another. A cover plate 310 rests on the upper side of the tensioning parts 308*a*, 308*b*, which cover plate is manufactured of a low friction material or has such a layer of low friction material on at least its upper side. The cover plate 310 has two protuberances 310*a* on its underside which, when the device 300 is assembled, extend into recesses in the upper side of the tensioning part 308*a*. The cover plate 310 prevents snow and dirt from penetrating into the inside of the support member 302 and between the tensioning parts 308*a* and 308*b*. The support member 302 has, in the region of the 180° bends in the band 304, crosspieces 311 protecting the band 304 against damage. Furthermore the support member 302 has noses 312 gripping over shoulders 308*c*, 308*d* of the two band tensioning parts 308*a*, 308*b* thus preventing a lifting of the band 304 off from the ski.

Figure 8:
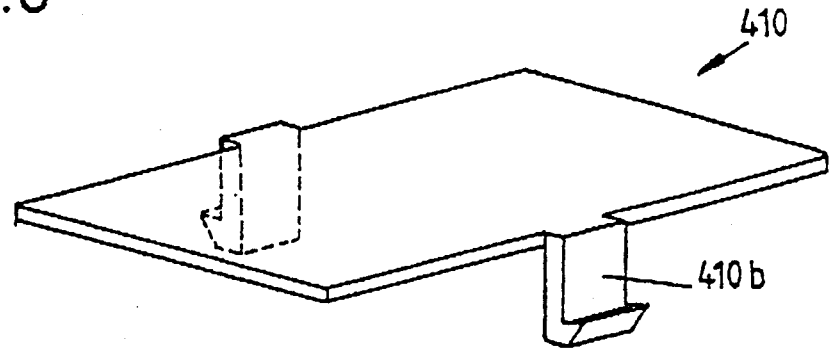

The modification according to FIG. 8, which is a diagrammatic illustration of the cover plate 410, shows tongues 410*b* instead of protuberances being arranged on the cover plate 410. The tongues 410*b*, in the assembled state of the device, are received in recesses in the support member 402.

Figure 9:
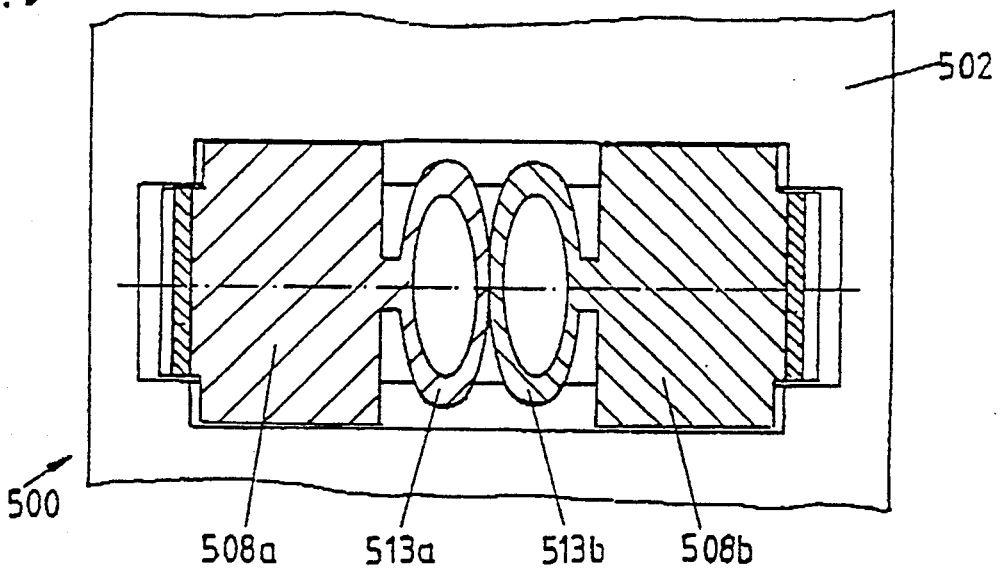

The sole support device 500 according to FIG. 9 is similar to the one illustrated in FIG. 7. It differs from the FIG. 7 device only in the two tensioning parts 508*a*, 508*b* being manufactured of plastic. In place of compression springs approximately elliptical plastic bars 513*a*, 513*b* are used, which are manufactured together with the tensioning parts and which, in the assembled state of the device 500, wherein they engage one another, urge the tensioning parts away from one another. This simplifies the manufacture of the device 500.

The sole support device 600 according to FIGS. 10 to 13 is also similar to the one according to FIG. 7. The support section of the support member 602 is here also formed by two band tensioning parts 608*a*, 608*b* guided with their two longitudinal sides in guideways of the support member 602. Both band tensioning parts 608*a*, 608*b* are loaded or biased by two compression springs 609 for urging the band tensioning parts away from one another. The support member 602 has crosspieces 611 in the region of the 180° bends in the band 604, which crosspieces 611 serve to protect the band 604 against damage. Furthermore, the support member 602 has noses 612 on both sides of the groove receiving the tensioning parts 608*a*, 608*b*. These noses 612 grip over shoulders 608*c* and 608*d* of the tensioning parts 608*a*, 608*b*. Each tensioning part 608*a* or 608*b* has a groove or trough-like structure 608*e* on its upper side for guiding the band 604 disposed therein.

In contrast to the embodiment according to FIG. 7, the cover plate 610, which is also manufactured of a low friction material, has according to FIGS. 10–13 in its central area a downwardly projecting key-shaped shoulder 610*c* holding the two band tensioning parts 608*a*, 608*b* in position. Furthermore, and as stated above the two tensioning parts 608*a*, 608*b* can be provided each with a groove or trough-like structure 608*e* on their upper side for guiding the band 604 therein. The cover plate 610 has wedge-shaped shoulders 610*d* on both sides, which shoulders 610*d*, in the assembled state of the device 600, bridge the gaps between the two tensioning parts 608*a*, 608*b*. FIG. 12*a* is a diagrammatic illustration of the design of the cover plate 610.

Figure 10:
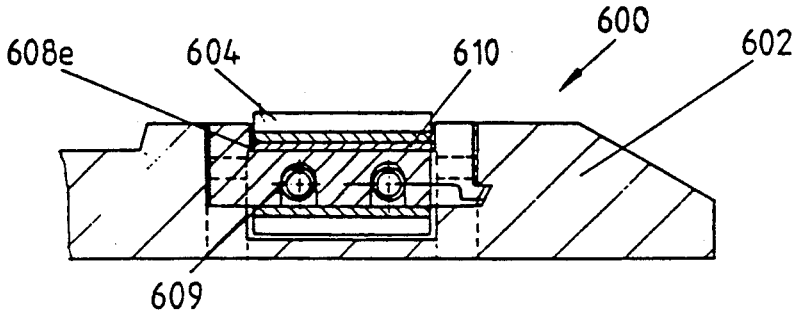
FIGS. 10 to 13 illustrates an embodiment similar to the embodiment according to FIG. 7, namely, a modification of a cover plate, FIG. 10 being a cross-sectional view taken along the line X—X of FIG. 11, FIG. 11 being a top view, FIG. 12 being a cross-sectional view taken along the line XII—XII of FIG. 11, FIG. 12*a* showing a detail of FIG. 12, and FIG. 13 being a cross-sectional view, similar to FIG. 12, illustrating a position during insertion of the band.
Figure 11:
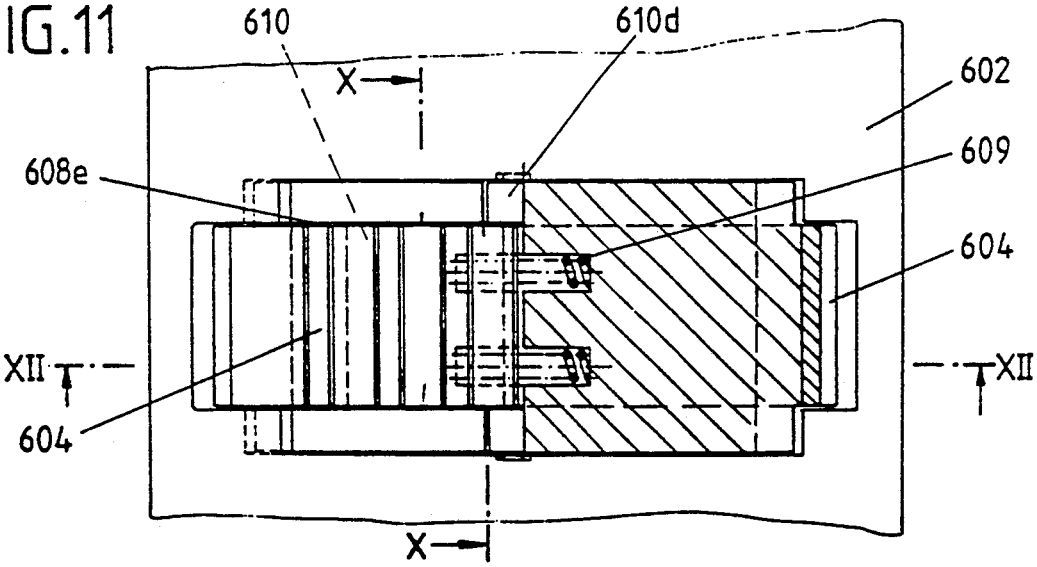
Figure 12:
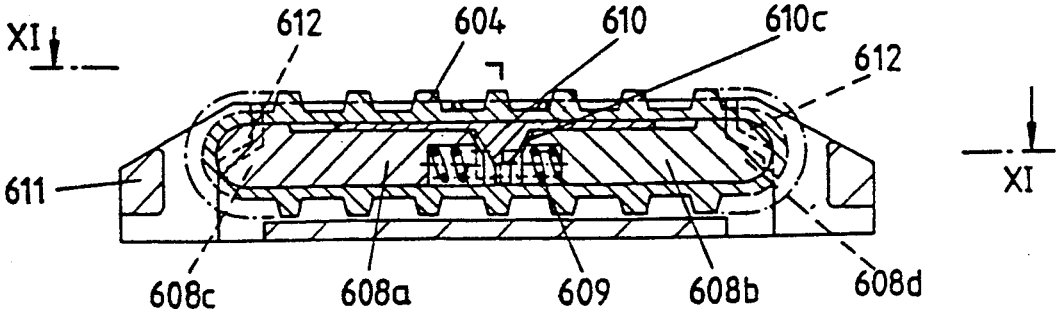
Figure 12A:
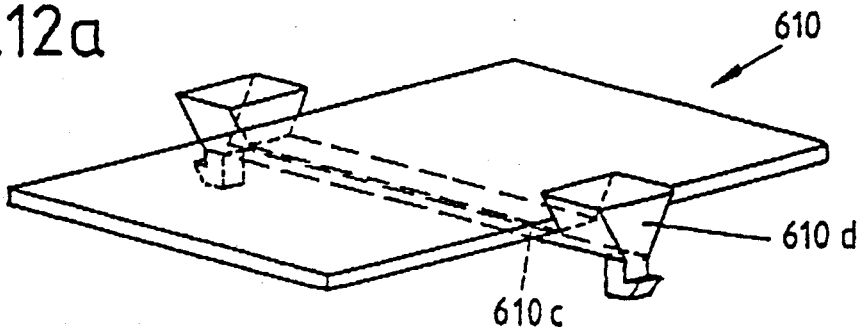
Figure 13:
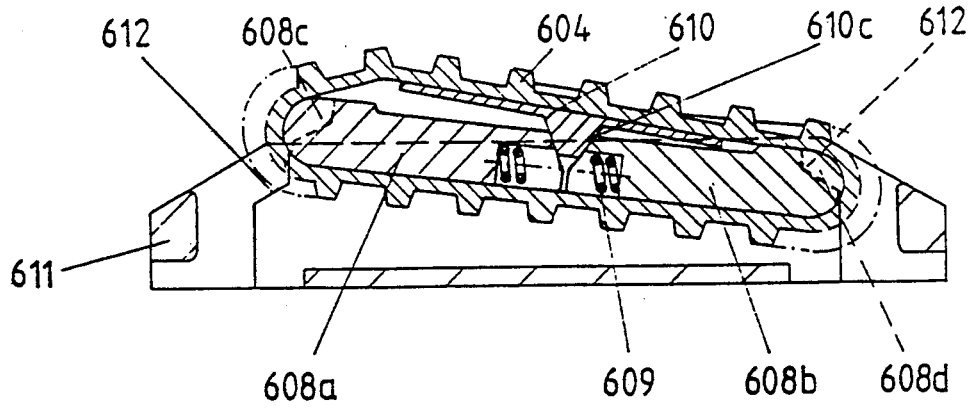

To enable the insertion of the band 604 in the exemplary embodiment according to FIGS. 10–12, the two band tensioning parts 608*a*, 608*b* are moved toward one another against the force of the compression springs 609. The band 604 is subsequently together with the two tensioning parts 608*a*, 608*b* moved in a sloping position into the opening of the support member 602 (FIG. 13). Care must be taken to make sure that the length of the tensioning parts 608*a*, 608*b*, after having been moved together, be shorter than the inside diameter between the front or inner surface on one nose 612 and the inner surface of a base of the other nose 612 on the support member 602. Whereas, if one wants to insert or remove the two tensioning parts 608*a*, 608*b* with the band 604 parallel with respect to the upper side of the ski, then the length of the tensioning parts 608*a*, 608*b*, after having been moved together, must at least be shorter than the opening in the support member 602 between the two noses 612.

Figure 14:
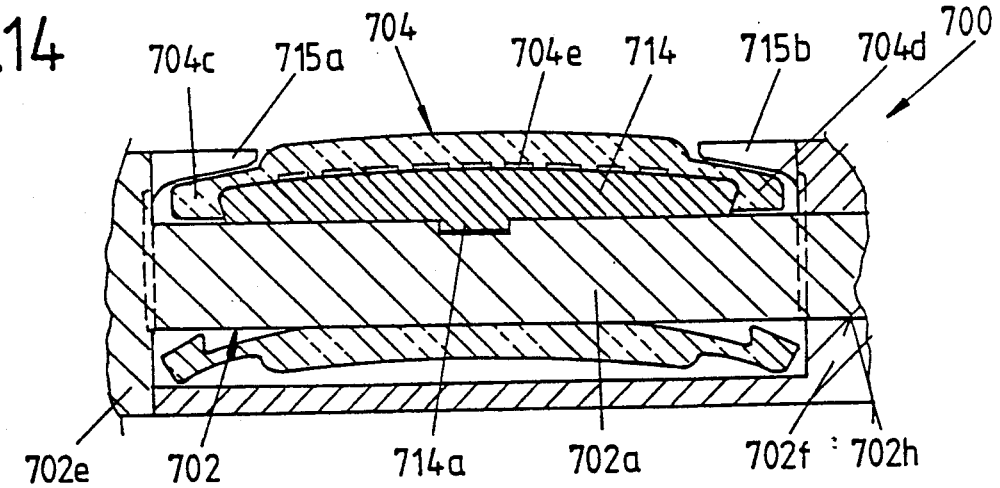
FIGS. 14 and 15 are cross-sectional views of two further embodiments according to the invention.

While in the up to now described bands 104–604 their support section 104*a*—viewed in cross section—is flat, this is not the case with the band 704 according to the sole support device 700 illustrated in FIG. 14. That is, the device 700 has a support member 702, the support section 702*a* of which carries an overlay 714 having approximately a dovetail cross section. The associated band 704 is thereby profiled and has inwardly projecting ribs 704*c*, 704*d* at both longitudinal sides, which ribs slightly grip under the overlay 714. Pockets 704*e* are recessed on the inner side of the band 704, which pockets receive lubricant facilitating the sliding of the band on the overlay 714.

Just like in the embodiment according to FIGS. 1 to 3, the support member 702 consists here also of two parts 702*e*, 702*f*, the separating line of which also extends transversely with respect to the longitudinal direction of the ski. The part 702*e* carries the support section 702*a* guided in a guideway 702*h* of the other part 702*f*. The overlay 714 has a shoulder 714*a* on its underside which is received in a corresponding recess in the support section 702*a*.

To prevent a lifting of the band 704 off from the overlay 714, both parts 702*e*, 702*f* carry tongues 715*a*, 715*b* directed against one another and grip over the band 704 near the 180° bends, thus securing the course of the band.

Figure 15:
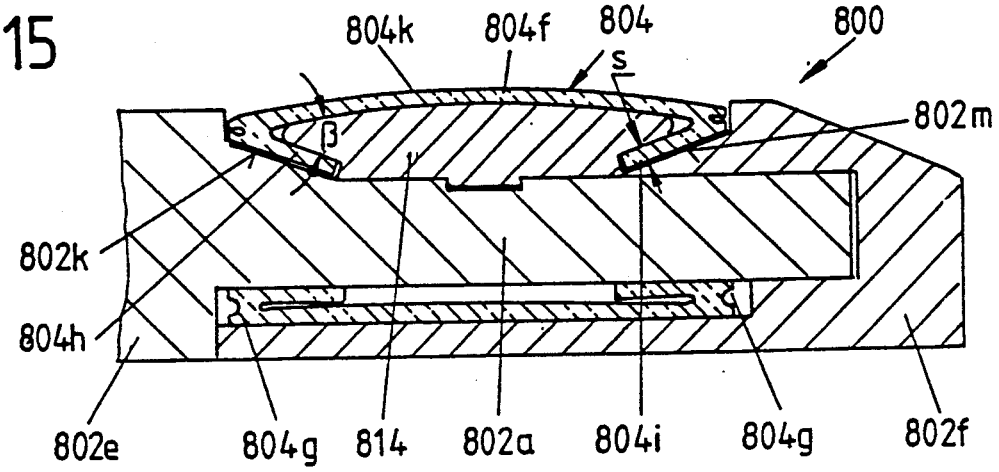

The sole support device 800 according to FIG. 15 is similar to the last described embodiment. The support member 802 is here also composed of two parts 802*e*, 802*f*, and the support section 802*a* of the part 802*e* carries an overlay 814 for the band 804. The latter is designed actually flat in cross section, however, has near its narrow side surfaces notches 804*g* extending in longitudinal direction of the band and enabling a folding over of the two edge areas 804*h*, 804*i* of the band 804. A reach 804*f* of the band 804 rests on the overlay 814 adjacent to the ski boot, which overlay 814 has a type of a dovetail cross section. The two edge areas 804*h*, 804*i* of the band 804 define, in the reach 804*f*, an acute angle $\beta$ with the central area 804*k* of the band 804.

Furthermore, the two parts 802*e*, 802*f* of the support member 802 are equipped with guide surfaces 802*k*, 802*m* which oppose the overlay 814 and form with the overlay 814 gaps s having approximately parallel boundary walls. A reliable guiding of the band 804 is thus assured in the area stressed most by boot contact.

Figure 16:
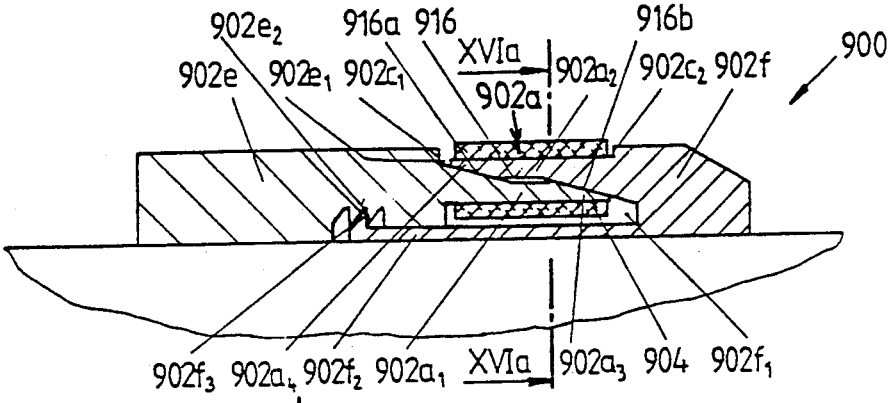
FIG. 16 is a vertical longitudinal center cross-sectional view of a further embodiment.
Figure 16A:
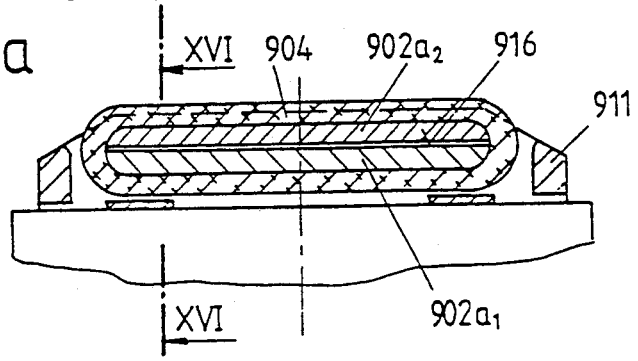
FIG. 16*a* is a cross-sectional view taken along the line XVIa—XVIa of FIG. 16.
Figure 17:
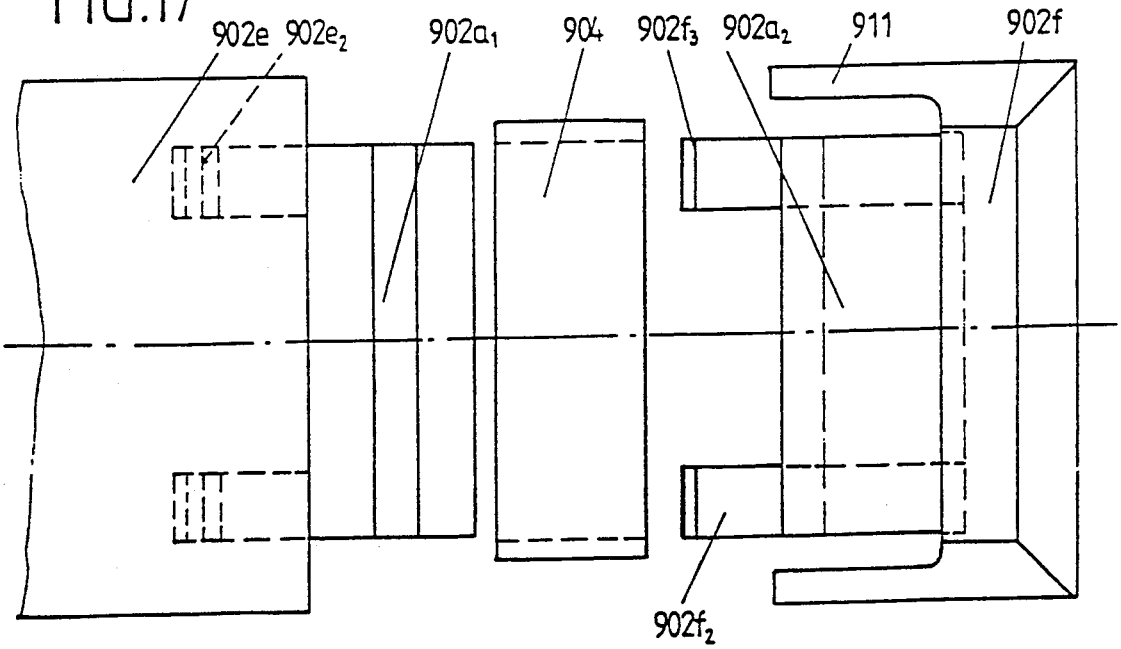
FIG. 17 is a top view of FIG. 16 in a pulled-apart state of the building elements.

The sale support support member 902 of the device 900 according to FIGS. 16, 16*a* and 17 is composed of two parts 902*e* and 902*f* made of an elastic plastic. A continuous band 904 is guided on the support member 902 between edge moldings 902*c*$_1$ and 902*c*$_2$ extending transversely with respect to the longitudinal direction of the ski and projecting upwardly adjacent the edge walls of the band. The area 902*a* of the support member 902, which area 902*a* carries the band 904, is divided into two sections 902*a*$_1$ and 902*a*$_2$ in an inclined direction by a separating plane 916. The one section 902*a*$_1$ is constructed in one piece with the part 902*e* and the other section 902*a*$_2$ is constructed in one piece with the part 902*f*. If the separating plane 916 extends parallel with respect to the upper side of the ski, the band 904 cannot be tensioned. If the separating plane 916, however, is slightly inclined with its end sections 916*a* and 916*b* with respect to the upper side of the ski, as this is illustrated in FIG. 16, then the two sections 902*a*$_1$ and 902*a*$_2$ form keys, the relative movement of which and the subsequent fixation of which can cause a tensioning of the band 904. The one section 902*a*$_1$ has a tapered, upwardly facing, end 902*a*$_3$ received in a recess 902*f*$_1$ of the part 902*f*, with the tapered end 902*a*$_3$ engaging the separating-plane section 916*b* of the part 902*f*. The other section 902*a*$_2$ has at its end 902*a*$_4$ a downwardly facing tapered key-shape which engages from above the separating-plane section 916*a* of the part 902*e*, with the part 902*e* having a free space 902*e*$_1$ in this area. Of course, the tapered end 902*a*$_3$ of the section 902*a*$_1$ and the tapered end 902*a*$_4$ of the section 902*a*$_2$ have the same angle of inclination as the two separating-plane sections 916*a* and 916*b*. The angle of inclination is preferably smaller than the friction angle between the materials of the parts 902*e* and 902*f*. A play or clearance exists between the free end 902*a*$_3$ of the section 902*a*$_1$ and the base of the recess 902*f*$_1$ in the part 902*f* in the assembled state of the support member 902. Crosspieces 911 are attached to one of the parts 902*e* 902*f*, which crosspieces extend in longitudinal direction of the ski and are near the 180° bends in the band 904 (see FIGS. 16*a* and 17).

The assembly of the sole-support device is simple. Both sections 902*a*$_1$ and 902*a*$_2$ of the two parts 902*e* and 902*f* of the support member 902 are first moved into the interior part of the endless band from opposite sides. A pressure is subsequently applied to the two parts 902*e* and 902*f* causing the key-shaped tapered end 902*a*$_3$ to move into the recess 902*f*$_1$ and the key-shaped tapered end 902*a*$_4$ into the free position 902*e*$_1$. At least one resilient tongue 902*f*$_2$ is provided and is attached to the part 902*f*, which resilient tongue 902*f*$_2$ carries a detent 902*f*$_3$ at its free end, which detent 902*f*$_3$ is adapted to selectively be received in a tooth space of a serrated portion 902*e*$_2$ having a saw-toothlike cross section. It is advisable when using key-shaped sections 902*a*$_1$ and 902*a*$_2$ to choose the spacing between the two edge moldings 902*c*$_1$ and 902*c*$_2$ larger than the width of the band 904, so that the band 904 can be tensioned, if during its manufacture its pregiven length has been exceeded. Operative movement toward one another terminates in the case when the tension of the band 904 has achieved the desired value.

Figure 18:
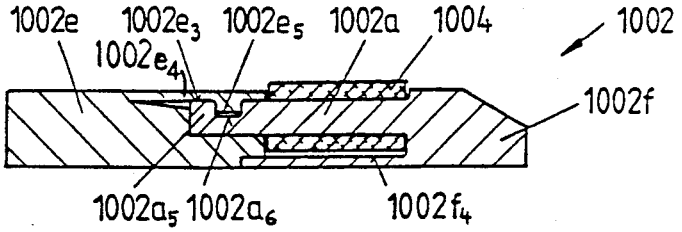
FIGS. 18 and 19 and also 20 and 21 illustrate two additional exemplary embodiments similar to the illustrations according to FIGS. 16 and 17.
Figure 19:
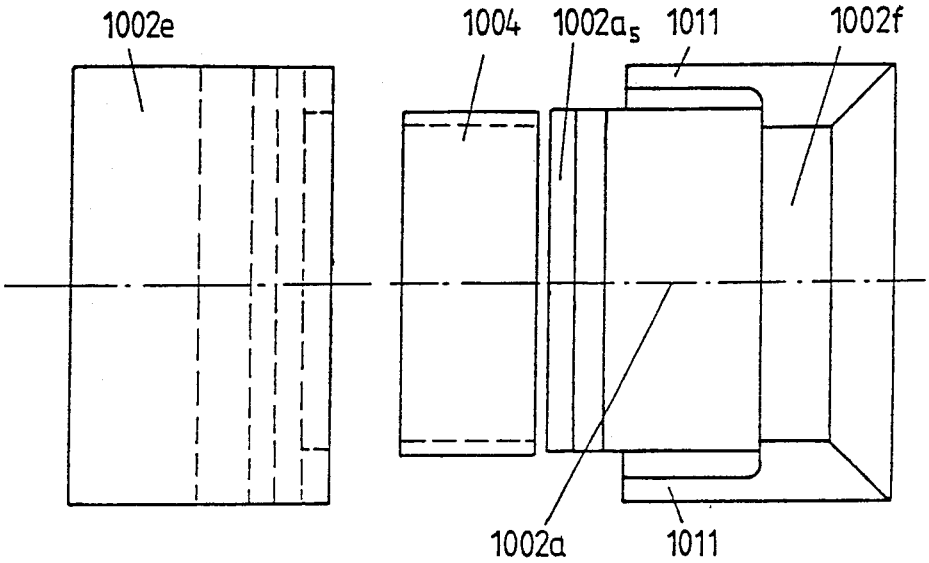

The support member 1002 of the sole support device 1000 according to FIGS. 18 and 19 is similar to the one discussed above. It differs from same in the shape of the divided support section 1002*a* constructed in one piece with the part 1002*f*. The support section 1002*a* has an extension 1002*a*$_5$, in which an upwardly open groove 1002*a*$_6$ is provided, which groove extends parallel with respect to the running direction of the band 1004. A guide groove 1002*e*$_3$ for the extension 1002*a*$_5$ is provided in the other part 1002*e*. A downwardly projecting rib 1002*e*$_5$ is provided on a resilient cover 1002*e*$_4$ on the part 1002*e*. The rib 1002*e*$_5$ is received in, in an assembled state of the two parts 1002*e* and 1002*f*, the groove 1002*a*$_6$ of the extension 1002*a*$_5$. The part 1002*f* has a further groove 1002*f*$_4$ utilized to receive the lower reach of the band and extends parallel with respect to the support section 1002*a*. This support member 1002*a* has also lateral crosspieces 1011 protecting the band 1004 against lateral damage.

Prior to the assembly of the two parts 1002*e* and 1002*f*, the band 1004 is moved onto and in an encircling relation to the support section 1002*f*. The extension 1002*a*$_5$ of the part 1002*f* is thereafter moved into the guide groove 1002*e*$_3$ of the part 1002*e*. As soon as the intended spacing between the parts 1002*e* and 1002*f* is achieved, the rib 1002*e*$_5$ moves into in the groove 1002*a*$_6$ of the extension 1002*a*$_5$ and the two parts 1002*e* and 1002*f* are fixed with respect to one another. This embodiment does not intend a tensioning of the band 1004. The band 1004 must therefore have a predefined length planed in the design.

Figure 20:
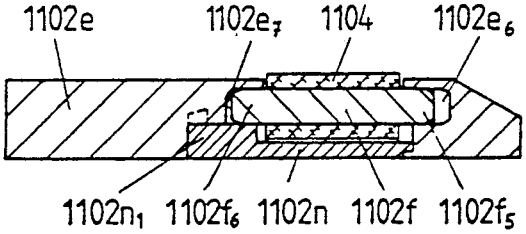
FIG. 20*a* shows a modification of FIG. 20.
Figure 20A:
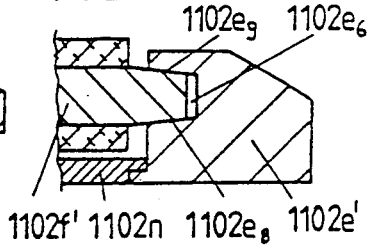
Figure 21:
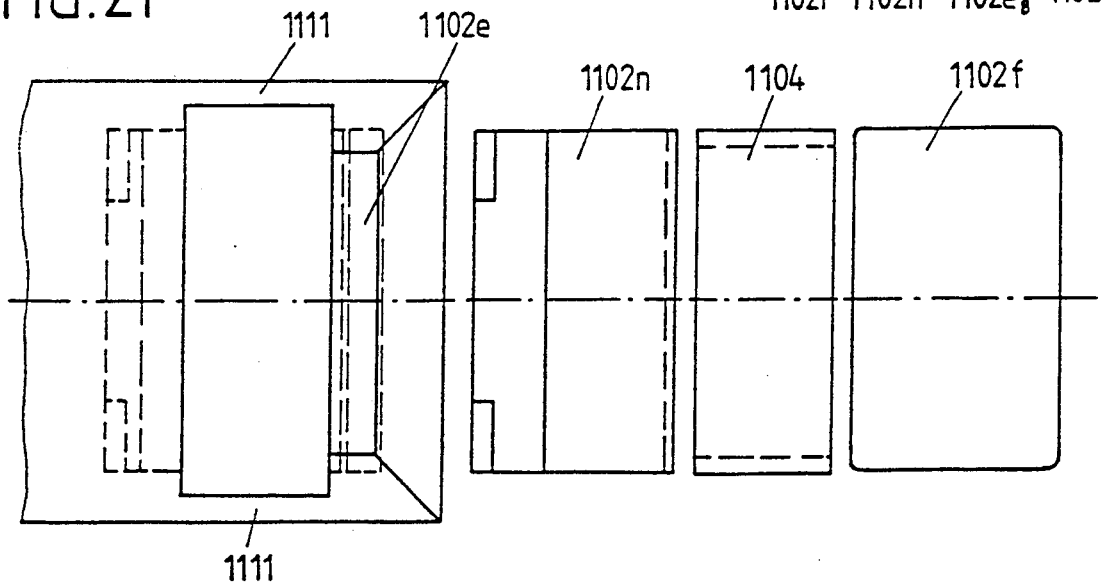

The support member 1102 according to FIGS. 20 and 21 consists of three parts 1102*e*, 1102*f* and 1102*n*. The part 1102*e* is constructed as a hollow bearing block having on one side of its internal cavity a recess 1102*e*$_6$ extending in direction of the ski boot and having approximately parallel side surfaces and, opposite the recess 1102*e*$_6$, a downwardly open recess 1102*e*$_7$. The part 1102*f* corresponds with the support section 1002*a* of the preceding exemplary embodiment. An endless band 1104 is first moved onto and in an encircling relation to the part 1102*f*. The part 1102*f* projecting with both ends 1102*f*$_5$ and 1102*f*$_6$ beyond the width of the band 1104 is thereafter moved inclined from below with one end 1102*f*$_5$ into the recess 1102*e*$_6$ and, thereafter, pivoted such that the other end 1102*f*$_6$ will end up in the recess 1102*e*$_7$. The third part 1102*n* is constructed as a cover plate and is thereafter attached from below to the first part 1102*e*, so that the first part 1102*e* is closed off at its underside. The cover plate 1102*n* has an upwardly directed projection 1102*n*$_1$ which opposes the recess 1102*e*$_7$ of the first part 1102*e* and which, after being attached to the first part 1102*e*, supports the projecting end 1102$f_6$ of the second part 1102$f$. Of course, this embodiment has also crosspieces 1111 on both sides of the band 1104 near its guide points, which crosspieces 1111 protect the band 1104 against damage. The so assembled support member 1102 can now be installed.

However, the second part 1102$f$—viewed in the direction of its longitudinal axis—is not secured against movement in this design. Thus, undesired axial movements may occur during movement of the band 1104. Help is here also given, according to the development of FIG. 20$a$, because the end area of the second part 1102$f'$, which end area faces and is received the recess 1102$e_6$, is tapered on both the upper and lower sides thereof and engages the converging lower and upper boundary walls 1102$e_8$ and 1102$e_9$ of the recess 1102$e_6$ conformed thereto. This, however, prevents an undesired shifting of the part 1102$f'$.

Figure 22:
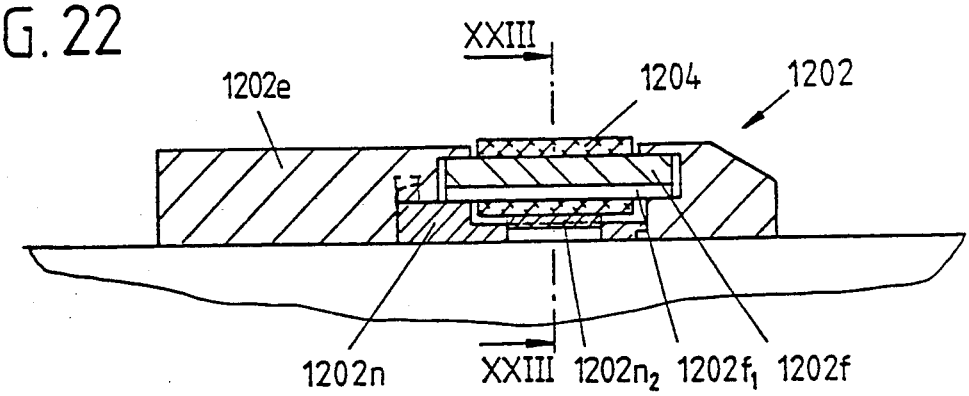
FIGS. 22 to 24 show a further embodiment of the subject matter of the invention, FIG. 22 being a vertical longitudinal center cross section, FIG. 23 being a cross sectional view taken along the line XXIII—XXIII of FIG. 22 and FIG. 24 being a top view, with the individual elements being pulled apart in the latter.
Figure 23:
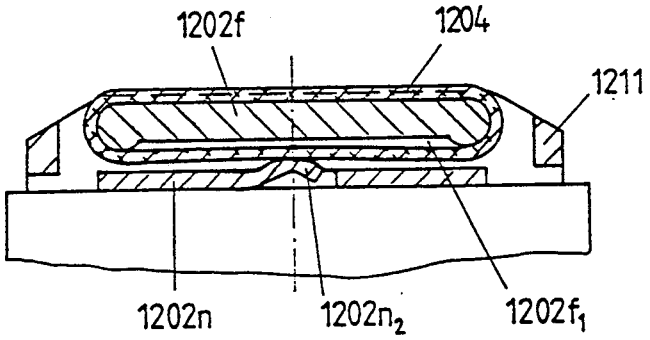
Figure 24:
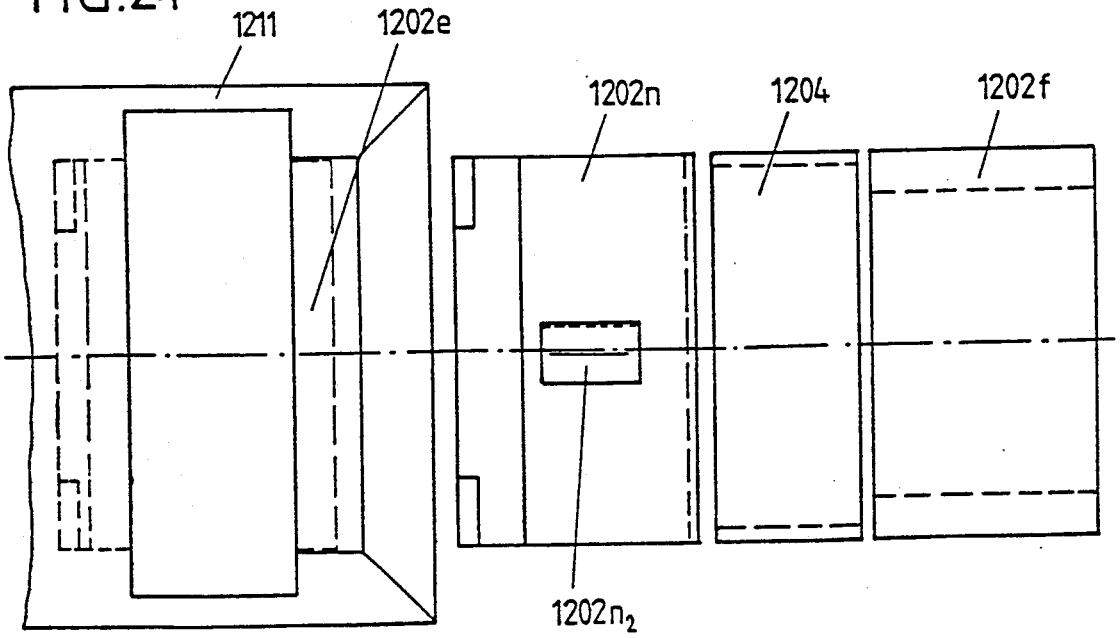

The support member 1202 in the sale support device 1200 illustrated in FIGS. 22 to 24 differs from the last described one 1102 due to the provision of a flat recess 1202$f_1$ in the underside of the part 1202$f$ and due to the part 1202$n$ being constructed as a cover plate having a resilient tongue 1202$n_2$ in its central region. The tongue 1202$n_2$ rests on the lower reach of the band 1204 and presses same into the recess 1202$f_1$ of the part 1202$f$. Deviations in the length of the band 1204 from the circumference of the part 2302$f$ can thereby also be balanced or compensated.

The invention is not to be limited to the exemplary embodiments described above and illustrated in the drawings. Rather, various modifications thereof are possible without departing from the scope of the invention. For example, the elevations on the band do not necessarily need to be ribs; they can also be in the form of plural bumps. Both the course of the ribs and also the arrangement of the plural bumps can be selected as desired. Furthermore, it is possible to arrange the ribs on the support section of the band also at an angle differing from 90°. Furthermore, it is possible to use leaf springs or cup springs as springs. Finally, it is important in the invention to utilize a resilient tongue for tensioning the band, which resilient tongue effects a tensioning of the lower reach of the band in direction toward the support section (FIGS. 22–24).

The embodiments of the invention in which an exclusive property or privilege is claimed are defined as follows:

1. In a sole support device comprising a support member adapted to be fastened on an upper surface of a ski, and an endless band which is guided on a support section of said support member between edge means extending transversely with respect to the longitudinal direction of the ski, said endless band including elevation means thereon projecting beyond the height of said edge means, the improvement wherein said support member and said support section are two separate parts to facilitate mounting of said endless band onto said support section, wherein guide means are provided on each of said two separate parts for guiding said two separate parts into a first relative position therebetween, and wherein connecting means are provided for connecting said two parts together when said two parts are in said first relative position.

2. The device according to claim 1, wherein the elevation means are designed like ribs which extend transversely with respect to the longitudinal direction of said band.

3. The device according to claim 1, wherein said support section of said support member is made of plastic, wherein said connecting means includes along a longitudinal length in a central region of said support member means defining a recess, said support section being divided into two elastic prongs, and wherein a spreader means is provided which is received into said recess for spreading said prongs apart to render said band taut and locked in place by locking means in said support section.

4. The device according to claim 3, wherein said spreader is in the form of a key which has two key surfaces on which is provided locking projections receivable in locking recesses in said support section.

5. The device according to claim 3, wherein said spreader is at least one of a cam-shaped and an eccentric-shaped, rotatable insert having at least two projections arranged symmetrically to one another, which insert is inserted into said support section in a receiving pocket located between the two prongs, said projections being provided on a shaft which extends perpendicularly with respect to the upper side of the ski, and wherein said projections are received in said receiving pockets in the two prongs.

6. The device according to claim 1, wherein said support section of said support member is defined by two band tensioning parts which are supported for movement toward and away from each other in guideways extending in transverse direction and parallel to the upper side of the ski in the support member, wherein at least one spring means is provided between said two tensioning parts for urging a separation of said tensioning parts.

7. The device according to claim 6, wherein said two band tensioning parts are made of plastic, and have on their sides facing one another ellipse-like bars defining said spring means, which bars, in the assembled state of said device engage one another.

8. The device according to claim 1, wherein said two parts are each made of an elastic plastic and of which one part is said support section and has pocketlike recesses therein, and the other part has tongues which, in the assembled state of said device, are received in the recesses of the first part.

9. The device according to claim 6, wherein a space between said two band tensioning parts is covered by a cover plate which has an upper surface aligned with a plane of a supporting area on said two band tensioning parts, said cover plate being at least one of made of a low friction material and having at least on its upper side a layer of such a material thereon.

10. The device according to claim 9, wherein said cover plate includes locking means in the form of at least one of means defining two protuberances on one of said tensioning parts at least one tongue on the support member.

11. The device according to claim 9, wherein a key-shaped shoulder is arranged on the underside of said cover plate, which shoulder holds said two tensioning parts in position, and wherein the cover plate on both sides is provided with key-shaped shoulders which, in the assembled state of said device, bridge the gaps between said two tensioning parts.

12. The device according to claim 9, wherein said two band tensioning parts are each provided with a trough means on their upper side, in which trough means said band is guided.

13. The device according to claim 1, wherein said band has at least one of inwardly projecting ribs and overlapped edges along its two edges, and wherein said support member has an overlay with a generally dovetail-shaped cross section in its support section.

14. The device according to claim 1, wherein said two parts are each composed of a plastic material, wherein said support section is divided into a pair of sections by a separating plane, of which sections each is constructed in one piece with an associated one of said two parts, and wherein each part of said support member has a recess, into which recess the end of said section of the other part is received.

15. The device according to claim 14, wherein a central area of said separating plane extends parallel with respect to a bearing surface of said support member.

16. The device according to claim 15, wherein said separating plane has at least one further area which is inclined with respect to said bearing surface of said support member, and wherein said two parts are fixed relative to one another by means of a locking device.

17. The device according to claim 14, wherein the end of the one section is tapered from above and is received in a recess on a first one of said two parts, with the tapered end engaging on an inclined area of the separating plane of the other section, and wherein said other section is tapered from below and engages from above an inclined area of said separating plane on a second one of said two parts, said second part having a free space in this area.

18. The device according to claim 1, wherein said two parts are each composed of a plastic material, wherein a first one of said parts of said support member has the support section and following said support section an extension is provided which has a groove therein, and wherein said first part of said support member has on a resilient cover a guide groove for receiving an extension therein as well as a rib extending in transverse direction into said guide groove, which rib, in the assembled state of said support member, is received in said groove of said extension.

19. The device according to claim 18, wherein a further groove is recessed in a second one of said parts having said support section, which groove extending parallel with respect to said support section and is utilized to receive a lower reach of said band.

20. The device according to claim 1, wherein said support member includes an additional third part, each of said parts being composed of a plastic material and of which a first one of said parts is a bearing block having means thereon for receiving a second one of said parts forming said support section, and wherein said third part, defining a cover plate, covers said bearing block on its underside.

21. The device according to claim 20, wherein said bearing block has means defining a recess for housing said band, which recess has on one side means defining a groove for receiving one end of said second part which forms said support section therein and, on the other side opposite said groove, a recess is provided into which the other end of said second part is inserted.

22. The device according to claim 21, wherein-viewed in the direction of the longitudinal axis of said second part—said two opposite ends of said second part have clearance with respect to said groove and said recess.

23. The device according to claim 20, wherein said second part forming said support section is supported on a side of said recess of said bearing block by a projection provided on the upper side of said cover plate.

24. The device according to claim 20, wherein said second part forming said support section is tapered at least on the periphery of one of its end areas and engages converging lower or upper boundary walls of said groove of said bearing block conformed thereto.

25. The device according to claim 20, wherein at least a part of said support member has lateral crosspieces provided in the area of 180° bends in said band.

26. The device according to claim 1, wherein between a lower reach of said band and the upper side of the ski, there is arranged a spring element loading said lower reach, and wherein said spring element is fixed on a section of said support member.

27. The device according to claim 20, wherein said third part has at least in its central area a resilient tongue loading a lower reach of said band.

28. The device according to claim 14, wherein at least a part of said support member has lateral crosspieces provided in the area of 180° bends in said band.

29. The device according to claim 18, wherein at least a part of said support member has lateral crosspieces provided in the area of 180° bends in said band.

30. The device according to claim 1, wherein said connecting means includes at least one tongue on at least one of said support member and said support section and at least one recess on the other of said support member and said support section, said guide means being provided on said tongue and in said recess, said connecting means further including means for lockingly holding said tongue and said recess together.

31. In a sole support device comprising a support member adapted to be fastened on an upper surface of a ski, and an endless band which is guided on a support section of said support member between edge means extending transversely with respect to the longitudinal direction of the ski and projecting upwardly relative to an associated edge of said band, the improvement wherein said band—viewed in a transverse cross section—consists of an endless support section and elevation means defining spaced apart elevations, said endless support section of said band being thinner than the height of the two edge means—viewed from said support section of said support member—said elevations projecting beyond the height of said edge means, wherein said support member and said support section are two separate parts to facilitate mounting of said endless band onto said support section, wherein guide means are provided on each of said two separate parts for guiding said two separate parts into a first relative position therebetween, and wherein connecting means are provided for connecting said two parts together when said two parts are in said first relative position.

* * * * *